US007908700B2

(12) United States Patent
DiPippo

(10) Patent No.: US 7,908,700 B2
(45) **Date of Patent: *Mar. 22, 2011**

(54) SELF-CLEANING HAIR BRUSH

(76) Inventor: Joe J DiPippo, Eastchester, NY (US)

( * ) Notice: Subject to any disclaimer, the term of this patent is extended or adjusted under 35 U.S.C. 154(b) by 1388 days.

This patent is subject to a terminal disclaimer.

(21) Appl. No.: 11/364,592

(22) Filed: Feb. 28, 2006

(65) Prior Publication Data

US 2007/0199170 A1 Aug. 30, 2007

(51) Int. Cl.

| | |
|---|---|
| ***A46B 17/06*** | (2006.01) |
| ***A46B 5/00*** | (2006.01) |
| ***A46B 9/08*** | (2006.01) |
| ***A45D 24/42*** | (2006.01) |

(52) U.S. Cl. ..... 15/169; 15/172; 15/38; 15/104.5; 119/628

(58) Field of Classification Search ..... 15/168, 15/169, 171, 172, 184, 38, 104.5; 119/628, 119/629; 132/119

See application file for complete search history.

(56) References Cited

U.S. PATENT DOCUMENTS

| | | | | |
|---|---|---|---|---|
| 1,280,204 | A | 10/1918 | Garber | |
| 1,303,500 | A | 5/1919 | Rosenberg | |
| 2,486,203 | A | 10/1949 | Pieper | |
| 2,916,757 | A | 12/1959 | Philip | |
| 3,059,260 | A * | 10/1962 | Peilet | 15/184 |
| 3,108,305 | A * | 10/1963 | Peilet | 15/169 |
| 3,110,053 | A * | 11/1963 | Surabian | 15/159.1 |
| 3,577,580 | A | 5/1971 | Rand | |
| 4,084,282 | A | 4/1978 | Calvert | |
| 4,517,703 | A | 5/1985 | Koke | |
| 5,267,528 | A | 12/1993 | Murieen, Sr. | |
| 5,519,912 | A | 5/1996 | Kawamura | |
| 5,862,563 | A | 1/1999 | Hartmann | |
| 5,904,150 | A | 5/1999 | Caristo et al. | |
| 6,427,633 | B1 * | 8/2002 | Ogden | 119/628 |
| 6,631,831 | B1 | 10/2003 | Loiselle | |
| 6,725,495 | B1 * | 4/2004 | Habibi | 15/160 |
| 2007/0199170 | A1 | 8/2007 | DiPippo | |
| 2007/0261187 | A1 | 11/2007 | DiPippo | |

* cited by examiner

*Primary Examiner* — Joseph J Hail, III
*Assistant Examiner* — Jamal Daniel

(57) ABSTRACT

A hair brush with a cleaning element for removing entwined hair from the brush after use. The cleaning element of the brush includes a plate(s) with opening through which the bristles protrude. When the plate is expanded, the plate pushes any hairs entwined in the bristles to the tips of the bristles where they are removed. The brush also has a post mechanism, which allows for the adjustment of the cleaning element to various intermediary positions, effectively adjusting the length of the bristles for use of the brush.

9 Claims, 8 Drawing Sheets

SELF-CLEANING HAIR BRUSH

FIELD OF THE INVENTION

The present invention relates to a self-cleaning hair brush that removes hair from the bristles of a hair brush in a thorough and convenient manner.

BACKGROUND OF THE INVENTION

Hair brushes are notoriously difficult to clean. The more bristles a brush has, perhaps the more effective the brush is as a tool, but also, the more difficult it is to clean. The use of brushes with self-cleaning capabilities of known designs and configurations is known in the prior art. More specifically, brushes with self-cleaning capabilities of known designs and configurations previously devised and utilized for the purpose of cleaning matter from the bristles of brushes through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,631,831 to Loiselle discloses a retractable bristle brush for removing hair from hair brushes. U.S. Pat. No. 5,862,563 to Hartmann discloses a removable cleaning plate for removing hair from hair brushes. U.S. Pat. No. 4,084,282 to Calvert discloses a power operated rotary brush for removing hair from hair brushes.

While these devices fulfill their respective, particular objectives and requirements, the aforementioned patents do not describe a self-cleaning hair brush that allows automatically removing hair from the bristles of a hair brush in a thorough and convenient manner.

In this respect, the self-cleaning hair brush according to the present invention substantially departs from the conventional concepts and designs of the prior art, and in doing so provides an apparatus primarily developed for the purpose of automatically removing hair from the bristles of a hair brush in a thorough and convenient manner.

Therefore, it can be appreciated that there exists a continuing need for a new and improved self-cleaning hair brush, which can be used for automatically removing hair from the bristles of a hair brush in a thorough and convenient manner. In this regard, the present invention substantially fulfills this need.

SUMMARY OF THE INVENTION

In view of the foregoing disadvantages inherent in the known types of brushes with self-cleaning capabilities of known designs and configurations now present in the prior art, the present invention provides an improved self-cleaning hair brush. As such, the general purpose of the present invention, which will be described subsequently in greater detail, is to provide a new and improved self-cleaning hair brush, which has all the advantages of the prior art and none of the disadvantages.

To attain this, the present invention is a hair brush with sliding parts (cleaning element) for hair removal. The hair brush has a brushing element supporting a plurality of bristles and a cleaning element having openings through which the bristles protrude. To use the brush, the cleaning element can be positioned at various distances from the brushing element to affect long or short bristles. To clean the hair brush, the cleaning element is fully extended (maximum cleaning position) away from the brushing element so that any hairs entwined in the bristles are forced to or off the tips of the bristles. The brushing element has a hollow body and the cleaning element is attached to a ring of springs and is further supported by a plate lifter, which is disposed within the brushing elements hollow body.

The brush has a control element used for adjusting the cleaning element to the various brushing positions and the cleaning position. Adjustments of the control element, moves the cleaning element relative to the brushing element. Specifically, the control element pulls the plate lifter within the brushing element propelling outward or inward until the cleaning element is in the desired position relative to the bristles.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self-cleaning hair brush, which has all of the advantages of the prior art brushes with self-cleaning capabilities of known designs and configurations and none of the disadvantages.

It is another object of the present invention to provide a new and improved self-cleaning hair brush, which may be easily and efficiently manufactured and marketed.

It is further object of the present invention to provide a new and improved self-cleaning hair brush, which is of durable and reliable constructions.

An even further object of the present invention is to provide a new and improved self-cleaning hair brush which is susceptible of a low cost of manufacture with regard to both materials and labor, and which accordingly is then susceptible of low prices of sale to the consuming public, thereby making such self-cleaning hair brush economically available to the buying public.

The above, and other objects, features and advantages of the present invention will become apparent from the following description read in conduction with the accompanying drawings, in which like reference numerals designate the same elements.

BRIEF DESCRIPTION OF THE DRAWINGS

The same reference numerals refer to the same parts throughout the various Figures.

DESCRIPTION OF THE PREFERRED EMBODIMENT

Figure 1:
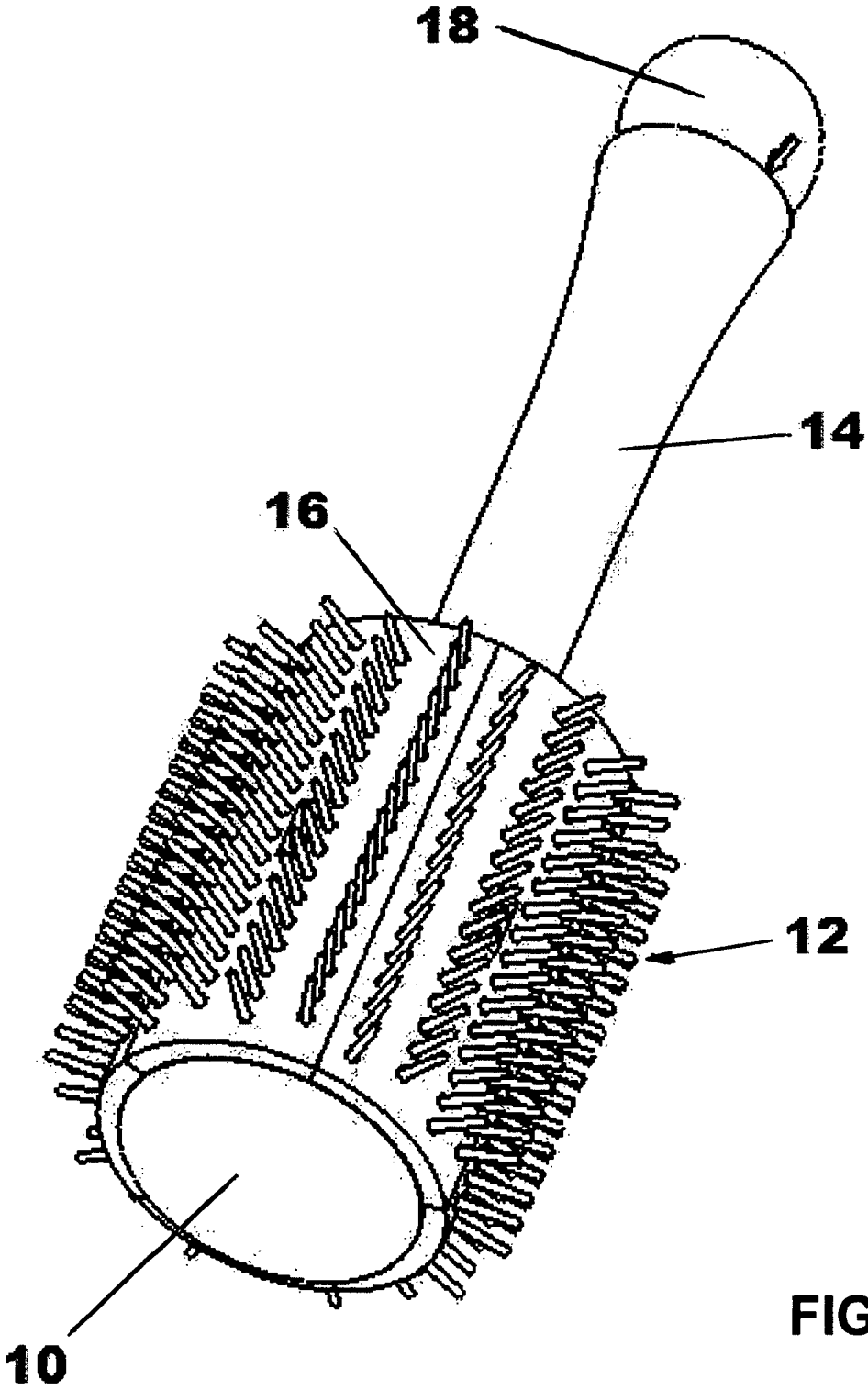
FIG. 1 is a schematic perspective view of the preferred embodiment of the present invention in a brushing position.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

In the preferred embodiment of the present invention, referring to FIG. 1, the hair brush has a hollow body 10 supporting numerous bristles 12 and a handle 14 connected to the body. The brush also has plate(s) 16 that are positioned flush to the brush body 10 such that the bristles 12 protrude through numerous openings 20 in the plate(s) 16. As the brush is used, hairs may become lodged among the bristles 12. The brush may then be cleaned by pulling the control element 18 outward, which moves the plate(s) 16, outward toward the tips of the bristles 12, thus pushing the entangled hair away from the body 10 and off the bristles 12.

Figure 2:
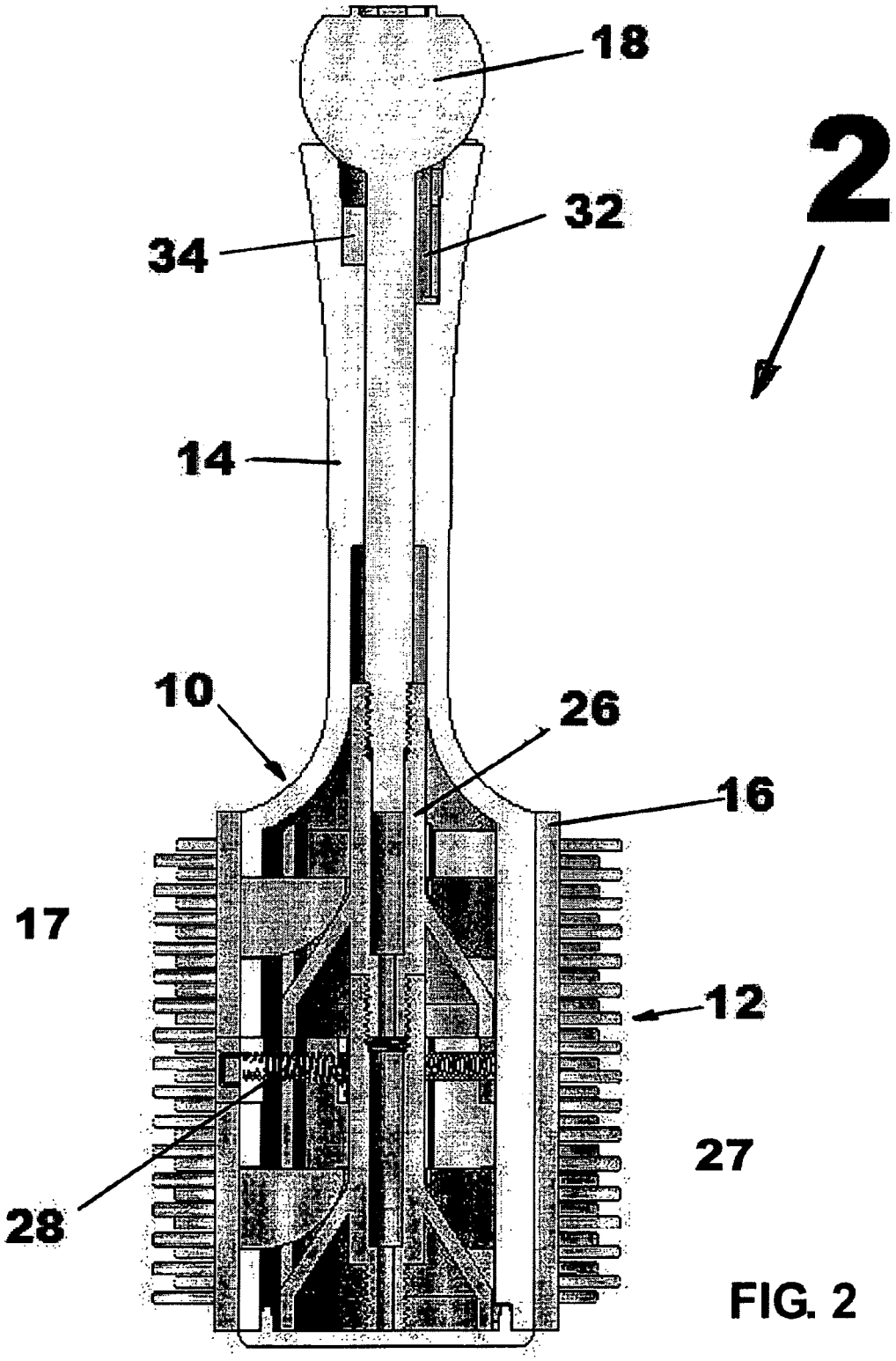
FIG. 2 is a cut away view of the preferred embodiment of the present invention showing the components thereof.
Figure 3:
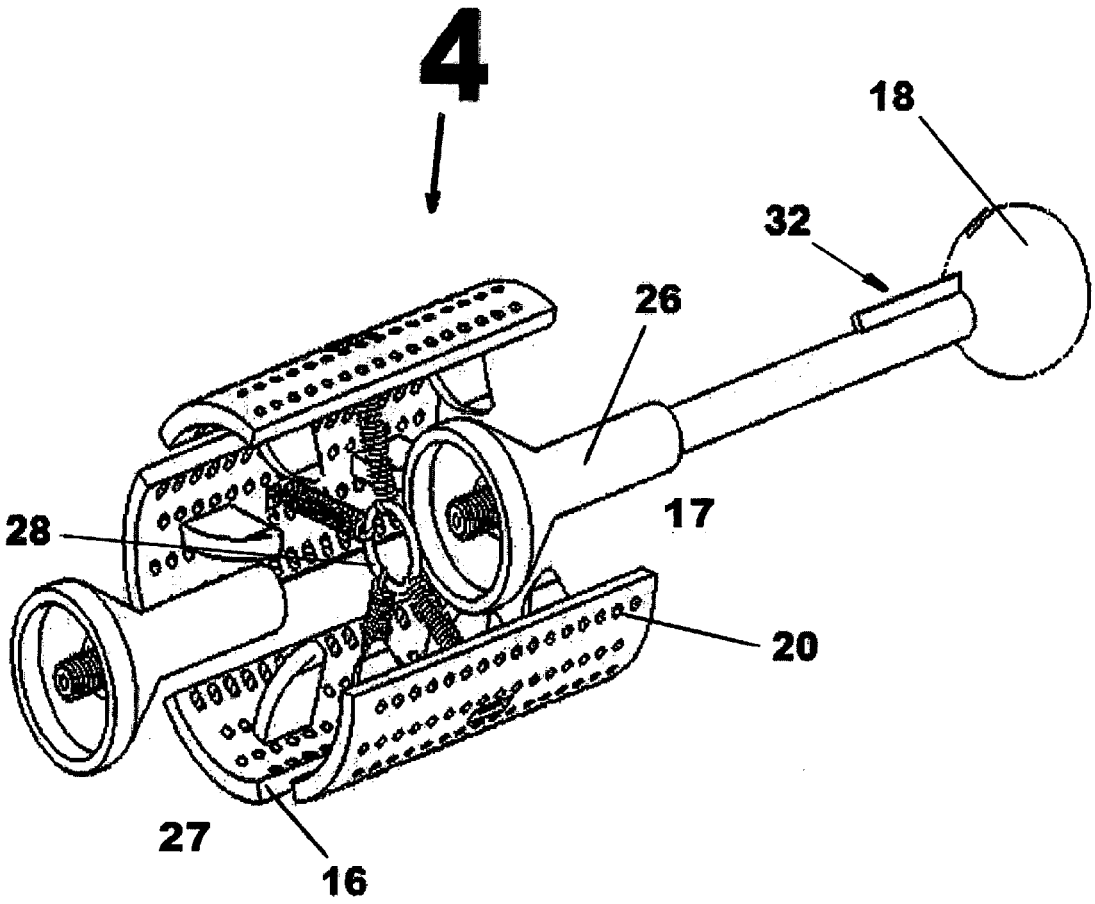
FIG. 3 is a partially exploded view of the preferred embodiment of the present invention showing the cleaning element components thereof with the hollow based body removed for clarity.

Referring to FIGS. 2 and 3, the hair brush can be comprised of three elements: a brushing element 2, a cleaning element 4, and a control element 18. The brushing element 2 has a hollow body 10 supporting an array of bristles 12, and handle 14. The body 10 is of a generally circular shape. The handle 14 is hollow and notched 34 on the inside to allow for adjustments to the length of the bristles 12. The handle 14 can be integrally formed with the body 10.

The body 10, handle 14, cleaning element 4, and control element 18, can be constructed from any substantially rigid material such as plastic, rubber, wood or metal. The bristles 12 are flexible and can be made of the same or different material as the body 10. Each bristle 12 can be a pin or clusters of pins. The bristles 12 can protrude from the body 10 at an angle instead of perpendicularly. The bristles 12 can be arranged in an array of straight columns and rows or arranged in an array of staggered rows. The ring of springs 28 is to be constructed of stainless steel materials or equivalent materials that are rust resistant.

The cleaning element 4 has plate(s) 16 a plate lifter 26 and a ring of springs 28. The plate(s) 16 is/are of the same general shape as the body 10 of the brushing element and have an array of openings 20, such that the bristles 12 are disposed through the openings 20. Each opening 20 can receive only one bristle 12. The plate lifter(s) 26 is/are positioned within the hollow body 10 of the brushing element. The ring of springs is positioned in-between the plate lifter(s) 26 and is attached individually to each plate(s) 16.

The control element 18 forms the end part of the handle of the hair brush. It has a round shape corresponding to the shape of the handle 14 of the brushing element 2. There are notched 34 steps inside the handle 14 of the brushing element 2. The end of the handle 14 where the control element 18 rests is numbered 0 through 5. These numbers 40 identify the different levels of notched 34 steps located inside of the handle 14. These notches 34 receive the parallel shaft 32 as set by the user in one of the six notches 40.

Figure 4:
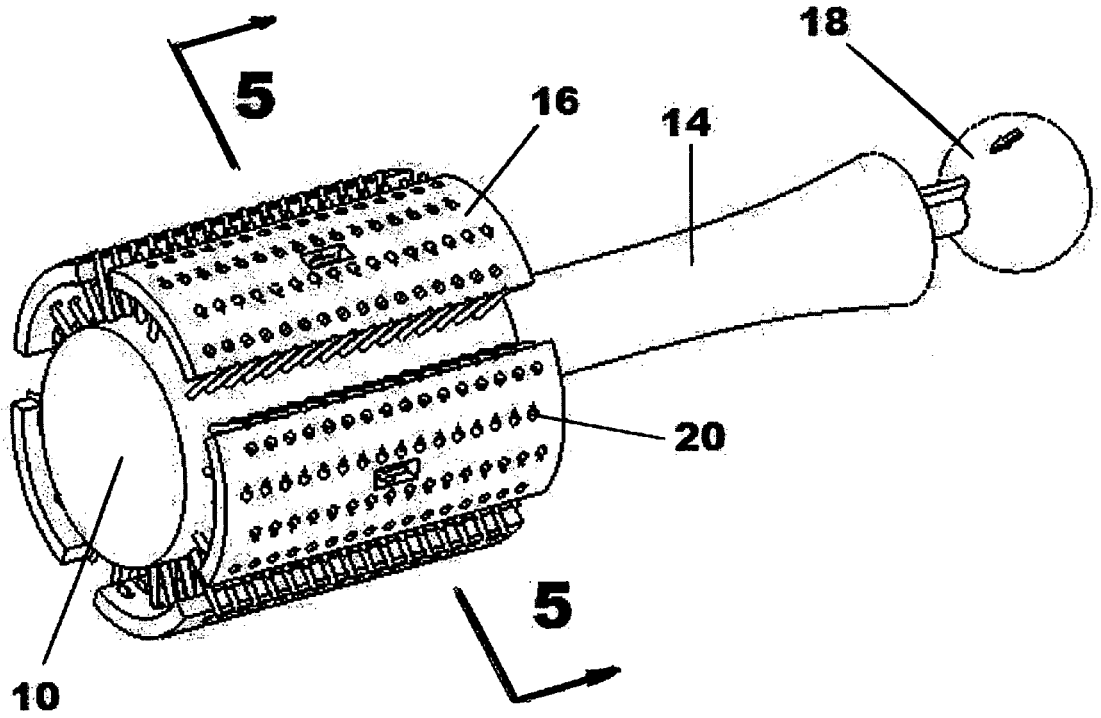
FIG. 4 is a schematic perspective view of the preferred embodiment of the present invention in the cleaning position.

Referring to FIG. 4, after using the brush, the brush can be cleaned by pulling the control element 18 outward. Pulling on the control element 18 outward pulls the plate lifter 26 outward which moves the plate(s) 16 outward to the tips of the bristles 12. As shown clearly in FIGS. 3 and 5, cam projectors 17 extend radially inwardly from each plate 16 and contact urging and sliding surfaces 27 on plate lifters 26 providing a uniform and sliding outward-urging force opposed by inward urging forces provided by respective spring assembly 28, during use along the entire length of each respective plate 16. Those of skill in the art of consumer design will recognize that positioning spring element assembly 28 generally centrally between a pair of cam projectors 17 and sliding surfaces 27 provides a balanced and uniform positioning and hair cleaning action. The control element is guided within the handle 14 of the brushing element 2. When the control element 18 is forward, the plate(s) 16 of the cleaning element 2 is approximately even with the tips of the bristles 12, such that the outer surface of the plate(s) 16 clears the tips of the bristles 12 while the inner surface of the plate 16 remains engaged with the tips of the bristles 12. Thus the plate(s) 16 pushes any hairs that were entwined in the bristles 12 to the tips of the bristles 12 where hairs fall off or are removed. As a consequence the present design provides a means for varying a useful-length of respective bristles 12 and for cleaning bristles 12 using the presently noted plates 16, at least in part. The control element 18 is returned to a brushing position, where the bristles 12 protrude through the plate(s) 16, by pushing in control element 18 back into the handle 14 of the brush element 2. Alternatively, upon the release of pressure on the control element 18, the ring of springs 28 (alternatively discussed as a spring assembly or elastic urging assembly) draws the control element 18 inward and returns the plate(s) 16 to the brushing position it was in before the brush was cleaned.

Figure 5:
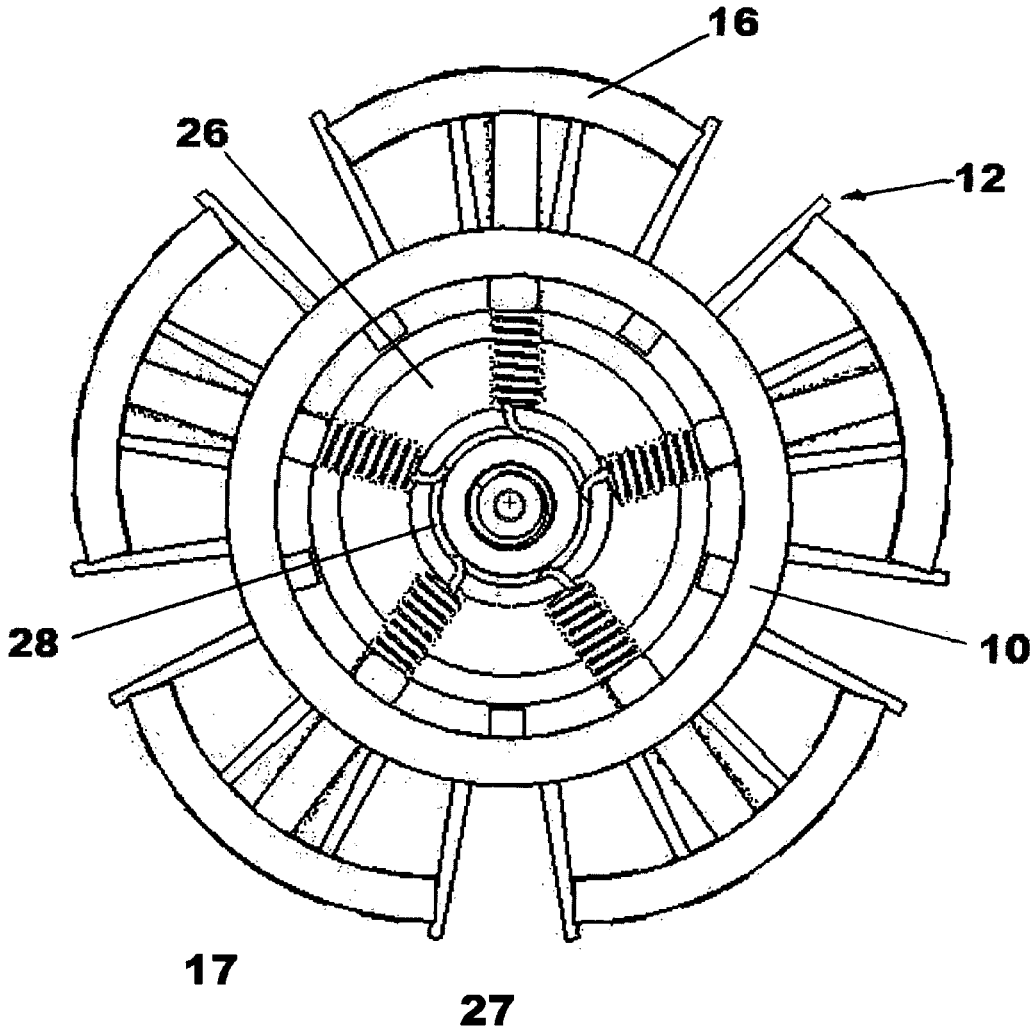
FIG. 5 is a cross-sectional view of the preferred embodiment of the present invention along the line 5-5 of FIG. 4 shown in a maximum cleaning condition.
Figure 6:
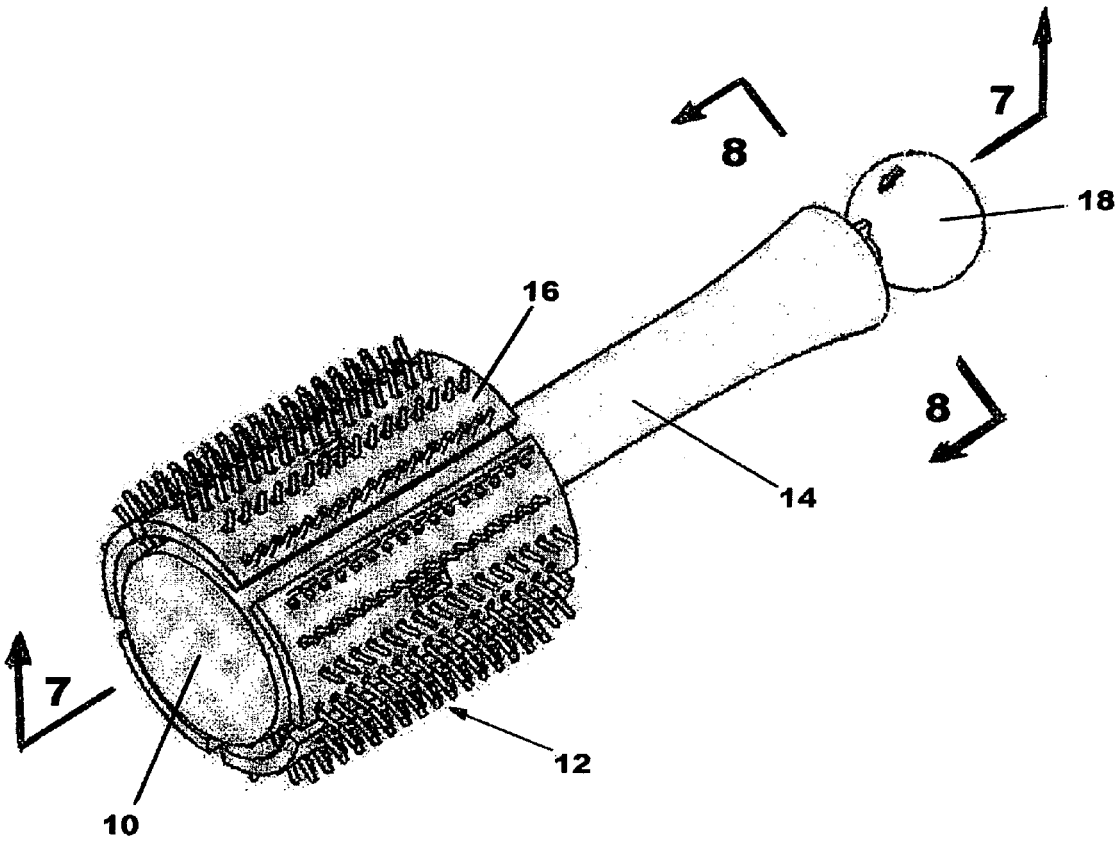
FIG. 6 is a schematic perspective view of the preferred embodiment of the present invention in an alternate brushing use position.

Referring now to FIG. 5, wherein a partial cross-sectional view along line 5-5 in FIG. 4 notes bristles 12 extending radially outwardly from a central portion of brush head element and hollow body 10. As can also be seen from reviewing FIG. 3, cantilever portions extending from plates 16 contact respective plate lifters 26 and move plates 16 radially outwardly along the direction of each bristle.

Those of skill in the art will appreciate that openings 20 may be of any shape effective to achieve the goals of the present invention. As a consequence of this realization, while holes 20 are show to be substantially circular in FIG. 1, those of skill in the art will appreciate that various shaped openings may be used, including oblong, ovoid, rectilinear, tapered along a depth of plate 16, and other shapes effective to both clean hair from bristles 12 and minimizing flexing of bristles 12 during a motion of plates 16 along the length of each bristle. As a consequence, it will be appreciated in FIGS. 5 and 3, that plates 16 are not intended to cause flexing of bristles 12 during operation, thus improving hair removal and bristle life.

It will also be noted from FIG. 5, that where plates 16 end along a row of bristles 12, holes 20 may partially exist on each respective plate (for example as a ½-circle or semi-ovoid). Thus, as noted in FIG. 1, plates 16 may have joints between rows of bristles 12, and as noted in FIGS. 4 and 5, plates 16 may have joints that end on a row of bristles 12, all without departing from the scope and spirit of the present invention. Since plates 16 operate along a length of respective bristles 12 either construction will operate effectively to remove hair and to moderate/adjust a useful bristle length, as will be discussed below.

The brush has multiple brushing positions. The cleaning element 4 can be raised so that its plate(s) 16 is/are substantially flush with the body 10 of the brushing element 2. In this position, the bristles 12 are at their full length. To set the brush to this first brushing position, the parallel shaft 32 is positioned within the lowest of the notched 34 steps. The parallel shaft 32 is set by pulling and turning the control element 18 in the appropriate direction to the targeted notch 34. Upon release of the pressure, the parallel shaft 32 engages within one of the notches of the handle 14. In addition, the plate(s) 16 can be adjusted to a plurality of intermediary fixable positions between the first brushing position (FIG. 1) and the cleaning position (FIG. 4). For example, the four intermediary positions set the plate(s) 16 at varying distances, e.g. ⅕ and ⅖ distance from the body 10. The effect of the intermediary positions is to vary the usable and operable length of respective bristles 12, i.e. long, medium and short.

Figure 7:
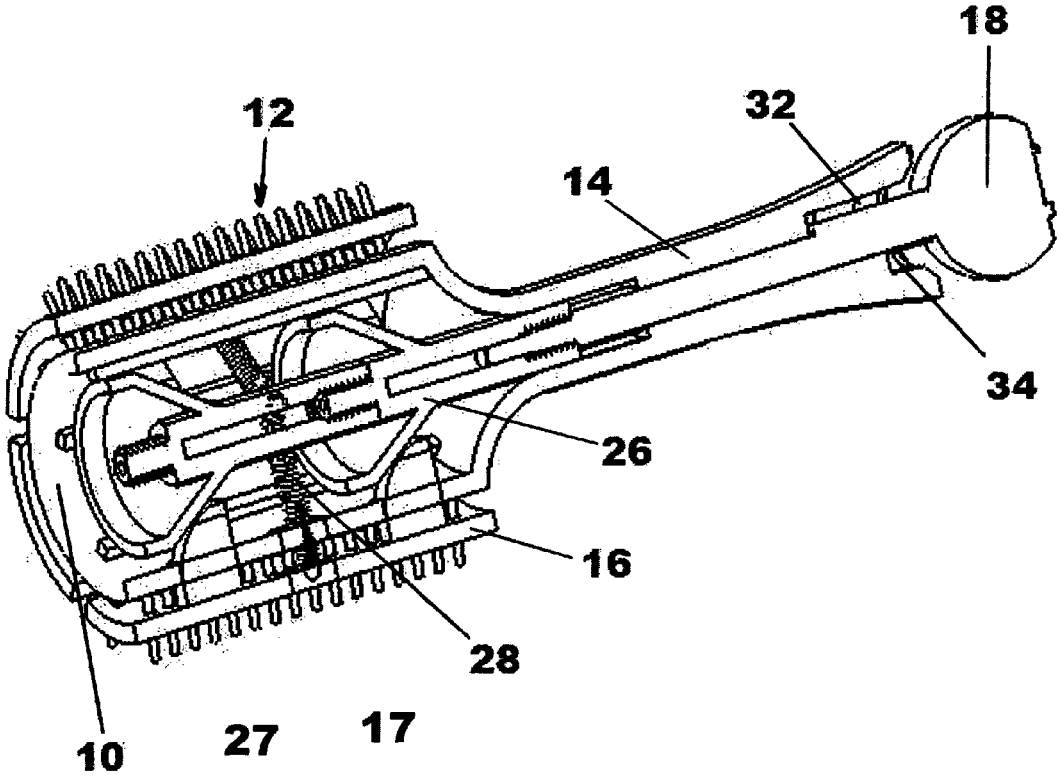
FIG. 7 is a schematic cross-sectional view of the preferred embodiment of the present invention along the line 7-7 of FIG. 6.
Figure 8:
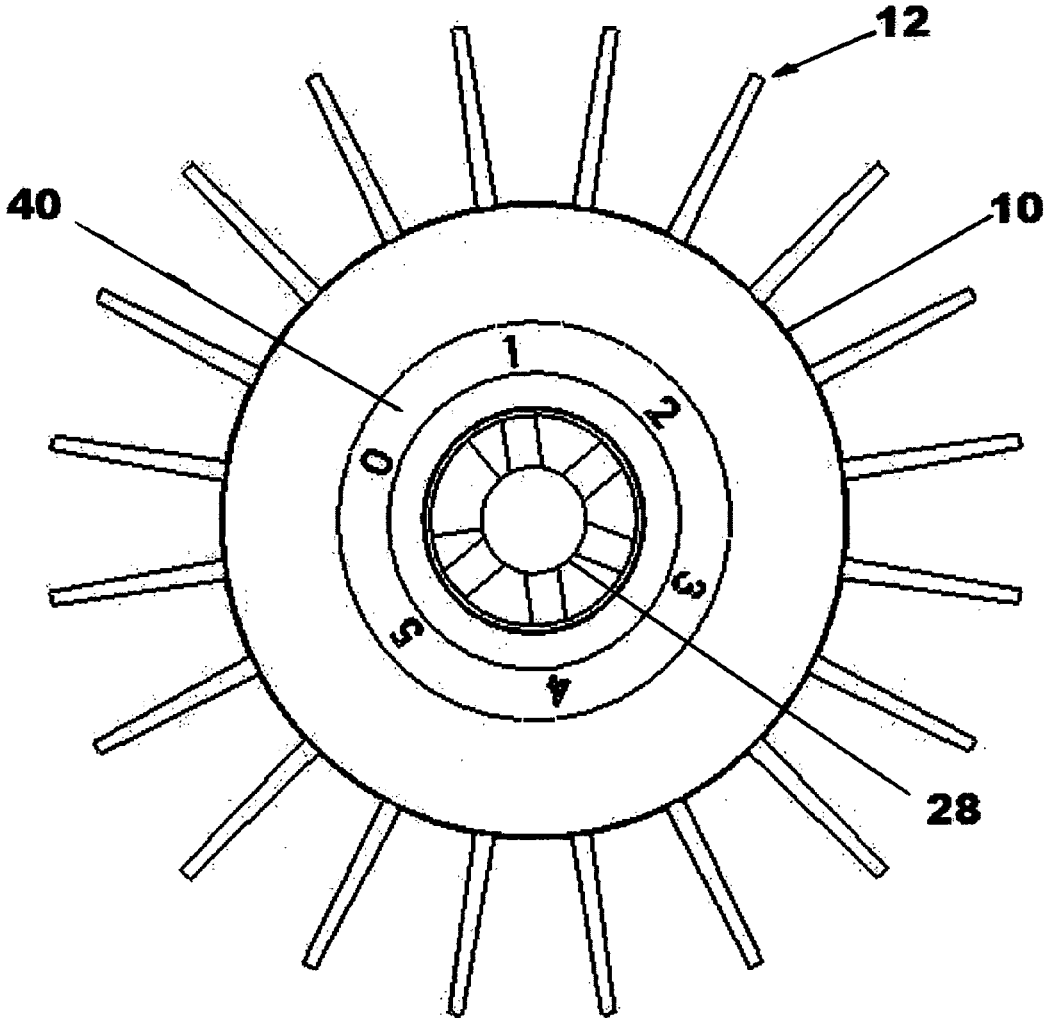
FIG. 8 is a cross-sectional view of the preferred embodiment of the present invention along the line 8-8 of FIG. 6.

Referring now to FIG. 7, when the parallel shaft is set to the notch 1, the plate(s) 16 is/are secured away from the body 10 at a distance of approximately ⅕ the full length of the bristles. Referring to FIG. 8, when the parallel shaft 32 is set to notch 4, the plate(s) 16 is/are secured at a distance from the body 10 of about ⅘ the full length of the bristle 12. Setting the parallel shaft 32 to level 4 effectively reduces the bristles 12 to a short length. The combination of the parallel shaft 32 and the notched 34 opening forms a locking mechanism because when the parallel shaft 32 is disposed within any of the notches 34, the cleaning element 4 is locked in position relative to the control element 18.

From any brushing position the brush can be cleaned by pulling the control element 18 outwardly away from the brush head, which in turn moves the cleaning element plate(s) 16 to the tips of the bristles 12 thereby removing the entangled hairs. After cleaning the brush, the plate(s) 16 of the cleaning element 4 are returned to a brushing position by pushing the control element 18 inward to the desired bristles 12 length. Pushing the control element 18 inward releases the tension on the ring of springs 28 which in-turn retracts the cleaning plate(s) 16.

As a consequence of the present description, in combination with the drawings, it should be readily understood by those of skill in the art that an operation of the cleaning elements relative to the brushing elements enables a mechanism or system for stripping or removing loose hair from bristles 12 in a direction substantially parallel to a bristle direction without requiring a bending or flexing of the bristles thereby minimizing a bristle flex stress during a cleaning step.

As to the manner of usage and operation of the present invention, the same should be apparent from the above description. Accordingly, no further discussion relating to the manner of usage and operation will be provided.

With respect to the above description then, it is to be realized that the optimum dimensional relationships for the part of the inventions, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A self-cleaning hair brush comprising, in combination:

a brushing element including a body, a plurality of bristles extending radially outward from a central axis of the body, the plurality of bristles being supported by the body and a handle supported by the body;

a cleaning element substantially surrounding the body of the brushing element, the cleaning element including a plurality of plates, each plate having a plurality of openings positioned relative to the bristles, a plate lifter and a ring with springs which supports the plurality of plates, and is disposed within the body of the brushing element; and a control element engaged with the plate lifter of the cleaning element which allows for the extraction of the control element at the end of the handle, wherein the plate lifter, ring with springs, and control element are configured and adapted to expand the plurality of plates radially outward from the body of the brushing element to facilitate removal of hairs therefrom when the control element is moved from a brushing position to a cleaning position, and wherein the plate lifter, ring with springs, and control element are configured and adapted to contract the plurality of plates radially inward toward the body of the brushing element to facilitate hair brushing when the control element is moved from the cleaning position to the brushing position.

2. The hair brush, according to claim 1, wherein the cleaning element is moveable with respect to the brushing element between a brushing position and a cleaning position, in the brushing position the plate(s) is/are flush with the brushing element such that the plurality of bristles protrude through the plurality of openings in the plate(s).

3. The hair brush, according to claim 2, wherein in the cleaning position the plate(s) is/are situated about the tips of the bristles (maximum cleaning position).

4. The hair brush, according to claim 2, further comprising: a locking element within the control element and the cleaning element to selectively lock the cleaning element in at least one intermediate position between the brushing position and the cleaning position producing different effective length of bristles at each intermediate position.

5. The hair brush, according to claim 2, further comprising: means for locking the control element relative to the cleaning element to selectively maintain at least one intermediate position so that the cleaning element is moveable between the intermediate position and the cleaning position upon operation of the control element.

6. The hair brush, according to claim 5, further comprising: means for returning the cleaning element to a locked intermediate position after the control element has been operated to the maximum cleaning position.

7. The hair brush, according to claim 1, wherein the cleaning element is movable with respect to the brushing element between a brushing position and a cleaning position, wherein the cleaning element is movable responsive to an external force applied to the control element.

8. The hair brush, according to claim 7, wherein the cleaning element is movable responsive to release of the external force applied to the control element.

9. The hair brush, according to claim 1, wherein the plurality of bristles are disposed in staggered rows.

* * * * *